United States Patent [19]

Harding

[11] Patent Number: 4,585,029

[45] Date of Patent: Apr. 29, 1986

[54] ELECTRO-HYDRAULIC SERVO VALVE

[75] Inventor: John K. Harding, Cheltenham, England

[73] Assignee: Dowty Hydraulic Units Limited, England

[21] Appl. No.: 698,603

[22] Filed: Feb. 5, 1985

[30] Foreign Application Priority Data

Feb. 17, 1984 [GB] United Kingdom ..... 8404169

[51] Int. Cl.[4] ..... F15B 13/043

[52] U.S. Cl. ..... 137/625.62; 91/365; 137/625.64

[58] Field of Search ..... 91/361, 363 R, 363 A, 91/365; 137/625.62, 625.64; 251/30

[56] References Cited

U.S. PATENT DOCUMENTS

| | | | |
|---|---|---|---|
| 3,752,189 | 8/1973 | Marr et al. | 137/625.65 |
| 3,835,888 | 9/1974 | Leutner et al. | 137/625.64 X |
| 4,310,143 | 1/1982 | Determan | 137/625.64 X |

FOREIGN PATENT DOCUMENTS

| | | | |
|---|---|---|---|
| 872072 | 7/1961 | United Kingdom . | |
| 1347550 | 2/1974 | United Kingdom | 137/625.62 |
| 989173 | 1/1983 | U.S.S.R. | 137/625.62 |

*Primary Examiner*—Gerald A. Michalsky

*Attorney, Agent, or Firm*—Hayes, Davis & Soloway

[57] ABSTRACT

An electro-hydraulic servo valve of two-stage type including a beam mounted for swinging movement with respect to the casing of the valve. One portion of the beam is engaged with the second-stage displaceable element of the valve and another portion of the beam carries an electrical sensor through which an electrical current is caused to pass. Magnet means are housed in the casing adjacent the other portion of the beam. As, on controlled movement of the displaceable element, the beam swings, the positional relationship of the sensor with respect to the magnetic fields of the magnet means changes, thus to so vary the electrical potential across the sensor that an electrical feedback signal is emitted by the sensor which is proportional to the displacement of said displaceable element.

7 Claims, 4 Drawing Figures

ELECTRO-HYDRAULIC SERVO VALVE

Figure 1:
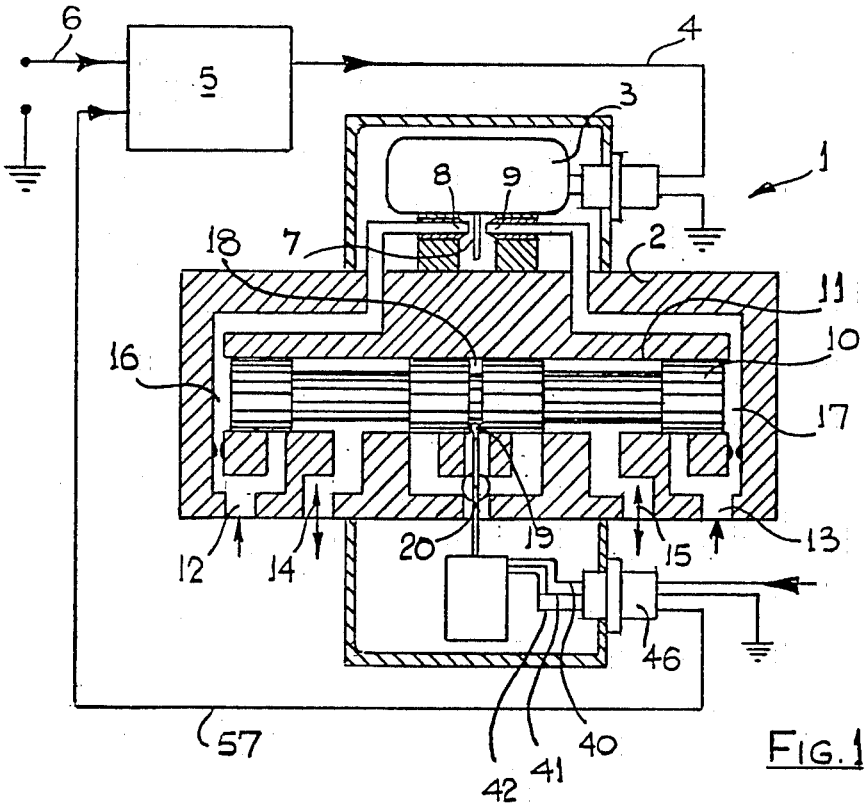

This invention relates to an electro-hydraulic servo valve.

Hitherto certain electro-hydraulic servo valves have been of two-stage type comprising a first-stage valve element operated by an electrical force motor and a second-stage valve element in the form of a spool or the like which has been axially-adjustable within the casing of the servo valve by fluid-pressure applied thereto under the control of said first-stage valve element. Such servo valves have been controlled by a low-power electrical command signal supplied to the input of the force motor and certain of those valves have included electrical feedback means from the spool or the like which generated an electrical feedback signal proportional to the displacement of the spool or the like and which effectively cancelled the effect of the command signal on the attainment of the selected position of the spool or the like. In one such servo valve the electrical feedback means comprised a plurality of electrical strain gauges arranged in a bridge circuit and carried by a beam, on end of which was in engagement with the spool or the like and the other end of which was earthed to the casing of the servo valve.

A disadvantage with such a feedback means is that the feedback signal is of relatively low power and as a result in some circumstances the response rate of the servo valve has not been as high as really desirable.

The invention as claimed is intended to provide a remedy. It solves the problem of how to design an electro-hydraulic servo valve in which means are provided by which an electrical feedback signal of relatively high power is generated.

According to this invention an electro-hydraulic servo valve includes a casing, a valve means forming a first stage of the servo valve and operable by an electrical force motor itself connected to receive an electrical command signal, a displaceable element, forming a second stage of the servo valve, which is movable within said casing by fluid-pressure applied thereto under the control of said first-stage valve means when operated by said force motor, a beam mounted for swinging movement with respect to said casing, one portion of said beam being engaged with said displaceable element and another portion of said beam carrying an electrical sensor through which an electrical current is caused to pass, and magnet means housed in said casing adjacent said other portion of said beam so that as on controlled movement of said displaceable element said beam swings, the positional relationship of said sensor with respect to the magnetic fields of said magnet means changes, thus to so vary the electrical potential across said sensor that an electrical feedback signal is emitted by said sensor which is proportional to the displacement of said displaceable element.

Preferably said magnet means comprise a pair of oppositely-polarised magnets each having pole pieces thus to define two air gaps, one in alignment with the other, and said beam being so arranged that the sensor is movable, on swinging of the beam, in the air gaps.

The beam may be mounted for its swinging movement upon a system of leaf springs and may have a ball or like formation provided on its said one portion which engages a groove formed in said displaceable element.

The displaceable element may comprise a spool or the like.

Preferably said sensor is of the "Hall-effect" type.

The advantages offered by the invention are mainly that since it is not necessary to provide for example a plurality of strain gauges in bridge formation on the beam, the means providing feedback does not include devices which might be susceptible to early failure due to bending loads applied thereto, and, by virtue of the cooperation of the sensor carried by the beam with the magnetic fields of the magnet means, electrical feedback signals of relatively high power are emitted by the sensor.

Figure 4:
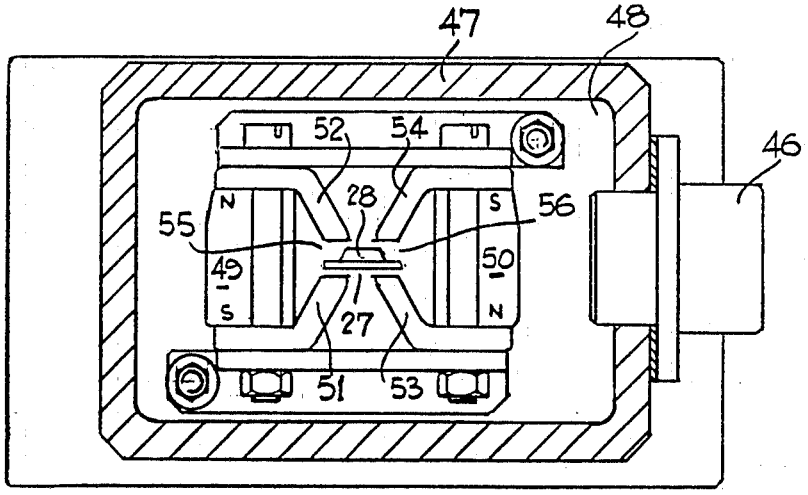
Figure 2:
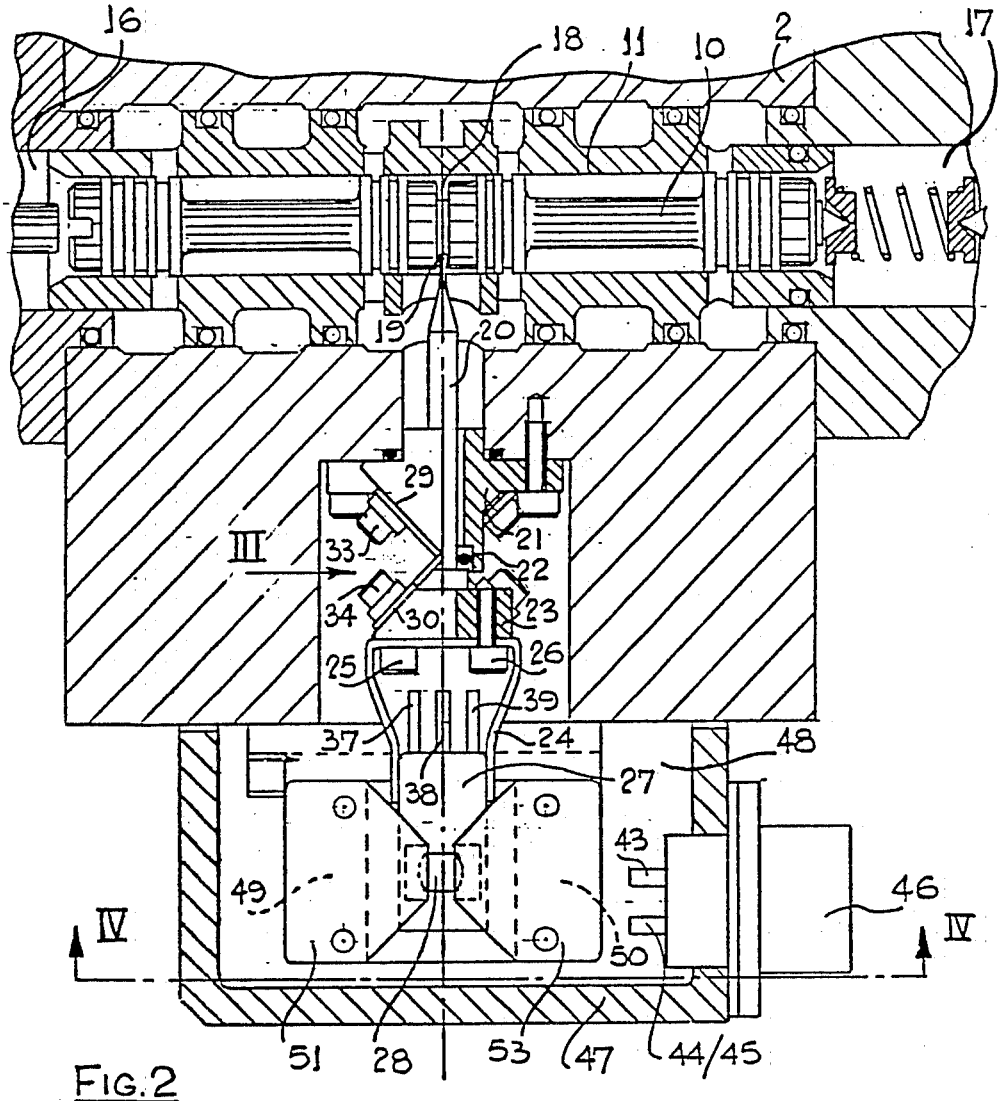
Figure 3:
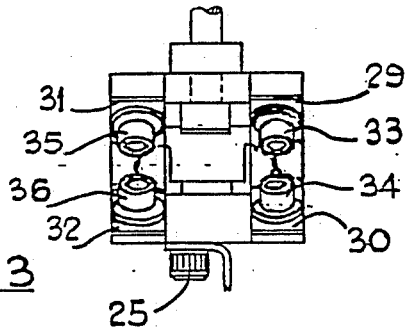

One way of carrying out the invention is described in detail below with reference to drawings which illustrate only one specific embodiment, in which:

FIG. 1 diagrammatically shows an electro-hydraulic servo valve and associated electrical control system, FIG. 2 is a detailed cross-sectional elevation of part of the electro-hydraulic servo valve diagrammatically shown in FIG. 1, FIG. 3 is a scrap view taken in the direction of the arrow III on FIG. 2, and FIG. 4 is a cross-section taken along the line IV—IV on FIG. 2.

In the drawings an electro-hydraulic servo valve 1 includes a main casing 2 on which an electrical force motor 3 is mounted. This motor is connected through conductor 4 to amplifier 5 and electrical command signals can be caused to pass through conductor 6 and by way of amplifier 5 and conductor 4 to the windings of motor 3.

The motor 3 is adapted in known manner to operate a first-stage valve element 7 in the form of a flapper which plays between two opposed nozzles 8, 9. A landed spool 10, forming a second-stage valve element and axially-movable in bore 11, is displaceable in either direction from a central, that is an equilibrium, position under the control of the first-stage valve element 7 when operated by the force motor 3. In its displaced condition the spool permits liquid under pressure introduced to the servo valve through ports 12, 13 to pass through service ports 14, 15 to one side or the other, as the case may be, of a double-acting fluid-pressure-operable service, for example a jack (not shown), controlled by the servo valve, while suitably placing the unpressurised side of that service in communication with reservoir. Such displacement of the spool is effected by an hydraulic pressure differential applied across chambers 16, 17 at the ends of spool 10 in dependence upon the obturation of one or other of nozzles 8, 9 by flapper 7.

The spool 10 is provided with a central annular groove 18 with which a ball-shaped end 19 of a beam 20 engages. As shown in FIG. 2 this beam extends downwardly through a beam-supporting housing 21 which carries a ring 22 about which the beam can swing on axial movement of the spool. The portion of beam 20 beneath ring 22 includes a block 23 and a yoke 24 which is secured to the block by screws 25, 26. The yoke carries a small circuit board 27 upon which an electrical sensor 28 is mounted. The beam is mounted for its swinging movement about ring 22 by means of two pairs of metallic leaf springs 29, 30; 31, 32 which are secured by screws, four of which are shown at 33, 34, 35, 36, to the housing 21 and block 23. The springs of each pair are set at right-angles to each other and are suitably recessed as shown at their centre portions to interleave one with respect to the other.

Three tags 37, 38, 39 project upwardly from the circuit board. These tags have conductors 40, 41, 42 attached to them which respectively connect with tags 43, 44, 45 provided on a multi-connector 46 carried in the wall of a cover member 47 secured to the underside of main casing 2.

The chamber 48 within cover member 47 houses two permanent magnets 49, 50 which are oppositely polarised and which each have a pair of soft iron pole pieces 51, 52; 53, 54. The magnets are so positioned that the pair of pole pieces of one are spaced a predetermined distance from the pair of pole pieces of the other, the air gaps 55, 56 between each pair of pole pieces being in alignment.

In the position shown in the drawings the beam 20 is in an equilibrium position corresponding to the equilibrium position of the spool 10.

The sensor 28 includes an integrated circuit incorporating a "Hall-effect" sensing element. This operates on the principle that when an electrical current is being passed through a conducting element and the element is placed in a magnetic field, a potential difference is generated across the edges of the element which is perpendicular both to the field and to the current. The integrated circuit of sensor 28 is suitably encapsulated and associated with micro circuitry providing a pre-amplifier which converts the potential difference across the sensor into an output voltage of relatively high, and thus useful, value.

With spool 10 in its equilibrium position beam 20 maintains the sensor in a neutral position centrally between the two magnets 49, 50. Since the magnets are oppositely polarised the effect of their magnetic fields upon the sensor are balanced out and thus no output is generated by the sensor.

If, for appropriate operation fo the associated service, spool 10 is caused by suitable operation of motor 3, under a command signal directed thereto through conductors 6 and 4, to move to the left in FIG. 2, the beam swings in the anti-clockwise direction about ring 22 so that sensor 28 moves to the right with respect to the magnets. Consequently the sensor moves closer into the air gap 56 and in the direction away from the air gap 55 resulting in rapid changes in flux densities in the two magnetic fields. In consequence the magnetic field of magnet 50 has a greater effect on the sensor than that of magnet 49 and since the difference of potential generated across the electrodes of the sensor is proportional to field strength an electrical potential is emitted by the sensor which is proportional to the extent of movement of spool 10 to the left. Thus a relatively high voltage position signal passes from the sensor through conductors 42, 57 to amplifier 5. When the movement of the spool is to such an extent that the magnitude of this signal effectively neutralises the command signal which is passing to amplifier 5 through conductor 6 and which originally energised motor 3 for such spool movement, the voltage signal supplied to motor 3 through conductor 4 is reduced to zero. Hence flapper 7 moves back to its neutral position and the spool is held in an hydraulically-balanced condition and thus moves no further to the left.

The service controlled by the servo valve continues to move in the selected direction and when it reaches a predetermined position a potentiometer associated with the output member of the service transmits a signal which in suitable manner cancels the command signal applied through conductor 6. The feedback signal which is still applied through conductor 57 to amplifier 5 and which is no longer balanced by the command signal results in an amplified signal being passed through conductor 4 to motor 3 in the sense to cause movement of flapper 7 to the left in FIG. 1. Consequently nozzle 8 is obturated, causing spool 10 to move to the right. With such movement the feedback signal passing through conductor 57 reduces in value and the signal passing from amplifier 5 to motor 3 likewise reduces. Thus the obturation of nozzle 8 by flapper 7 becomes less and when the spool reaches its neutral position the flapper likewise assumes a neutral position mid-way between nozzles 8 and 9.

If it is required to operate the service in the opposite direction the electro-hydraulic servo valve is operated in the converse sense, a command signal introduced to the motor 3 by way of amplifier 5 then causing spool 10 to move to the right away from its neutral position, and the beam 20 and sensor 28 in association with magents 49, 50 operate again to provide feedback to amplifier 5.

The invention is not limited to an electro-hydraulic servo valve having a first-stage valve element in the form of a flapper as in alternative embodiments of the invention the first-stage valve element may instead be of other type, for example a jet pipe which is cooperable with adjacent receptor orifices.

Although in the embodiment above described with reference to the drawings the said displaceable element comprises a spool, in alternative embodiments of the invention the displaceable element may comprise any other suitable member, for example a ported slider of rectangular cross-section.

I claim:

1. An electro-hydraulic servo valve including a casing, a valve means forming a first stage of the servo valve and operable by an electrical force motor itself connected to receive an electrical command signal, a displaceable element, forming a second stage of the servo valve, which is movable within said casing by fluid-pressure applied thereto under the control of said first stage valve means when operated by said force motor, a beam mounted upon a system of leaf springs for swinging movement with respect to said casing and about a ring itself carried in a beam-supporting housing, one portion of said beam being engaged with said displaceable element and another portion of said beam carrying an electrical sensor through which an electrical current is caused to pass, and magnet means housed in said casing adjacent said other portion of said beam so that as, on controlled movement of said displaceable element, said beam swings, the positional relationship of said sensor, with respect to magnetic fields inherent in said magnet means, changes, thus to so vary electrical potential across said sensor that an electrical feedback signal is emitted by said sensor which signal is proportional to the displacement of said displaceable element.

2. A servo valve as claimed in claim 1, wherein said magnet means comprise a pair of oppositely-polarised magnets each having pole pieces thus to define two air gaps, one in alignment with the other, and said beam being so arranged that said sensor is movable, on swinging of the beam, in the air gaps.

3. A servo valve as claimed in claim 1, wherein said beam has a ball formation provided on its said one portion which engages a groove formed in said displaceable element.

4. A servo valve as claimed in claim 1, wherein said displaceable element comprises a spool.

5. A servo valve as claimed in claim 1, wherein said system of leaf springs comprises two pairs of leaf springs, the springs of each pair being set substantially at right angles to each other and being so recessed at their center portions as to interleave one with respect to the other.

6. A servo valve as claimed in claim 1, wherein said sensor includes an integrated circuit incorporating a "Hall-effect" sensing element.

7. An electro-hydraulic servo valve including a casing, a valve means forming a first stage of the servo valve and operable by an electrical force motor itself connected to receive an electrical command signal, a displaceable element, forming a second stage of the servo valve, which is movable within said casing by fluid-pressure applied thereto under the control of said first stage valve means when operated by said force motor, a beam mounted upon a system of leaf springs for swinging movement with respect to said casing and about a ring itself carried in a beam-supporting housing, said system of leaf springs comprising two pairs of leaf springs the springs of each pair being set substantially at right angles to each other and being so recessed at their center portions as to interleave one with respect to the other, and one portion of said beam being engaged with said displaceable element while another portion of said beam carries an electrical sensor through which an electrical current is caused to pass, and magnet means housed in said casing adjacent said other portion of said beam.

* * * * *